United States Patent [19]

Reinhardt et al.

[11] 4,224,030

[45] Sep. 23, 1980

[54] DURABLE PRESS FINISHING TREATMENT FOR CELLULOSE TEXTILES EMPLOYING AN ALUMINUM ACETATE CATALYST SOLUTION

[75] Inventors: Robert M. Reinhardt, New Orleans; Russell M. H. Kullman, Harahan, both of La.

[73] Assignee: The United States of America as represented by the Secretary of Agriculture, Washington, D.C.

[21] Appl. No.: 1,134

[22] Filed: Jan. 5, 1979

[51] Int. Cl.[2] ..... D06M 13/14; D06M 15/54; D06M 15/58; D06M 9/00

[52] U.S. Cl. ..... 8/115.7; 8/182; 8/184; 8/186; 8/187; 8/116.4

[58] Field of Search ..... 8/182, 184, 186, 187, 8/116.4, 115.7

[56] References Cited

U.S. PATENT DOCUMENTS

| | | | |
|---|---|---|---|
| 2,530,175 | 11/1950 | Pfeffer et al. | 8/116.4 |
| 2,541,457 | 2/1951 | Beer | 8/116.4 |
| 2,992,138 | 7/1961 | Bacon | 427/337 |
| 3,165,374 | 1/1965 | Hushebeck | 8/186 |
| 3,186,954 | 6/1965 | Hushebeck | 8/116.4 |
| 3,526,474 | 9/1970 | Reeves et al. | 8/186 |
| 3,634,019 | 1/1972 | Beaumont et al. | 8/182 |
| 3,827,994 | 8/1974 | Cicune et al. | 8/182 |
| 3,933,426 | 1/1976 | Martini et al. | 8/184 |

OTHER PUBLICATIONS

Irvine et al. Amer. Dyestuff Reporter 6/15/1959 pp. 37–50.

Hood et al. Journ. Amer. Chem. Soc. 72 p. 2094 (1950).

*Primary Examiner*—Joseph L. Schofer
*Assistant Examiner*—Maria S. Tungol
*Attorney, Agent, or Firm*—M. Howard Silverstein; David G. McConnell; Raymond C. Von Bodungen

[57] ABSTRACT

An aluminum acetate salt solution containing sodium and chloride ions is prepared by reaction of aqueous aluminum chloride and sodium acetate. It is suitable for use as a catalyst in the treatment of cellulosic-containing textiles with formaldehyde or a formaldehyde-amide adduct crosslinking agent to produce durable press properties in the finished material. There is no discoloration in the thus-treated fabric which also exhibits greater strength than is normally present in fabric treated to the same level of wrinkle resistance with an aluminum salt catalyst.

2 Claims, No Drawings

DURABLE PRESS FINISHING TREATMENT FOR CELLULOSE TEXTILES EMPLOYING AN ALUMINUM ACETATE CATALYST SOLUTION

BACKGROUND OF THE INVENTION

1. Field of the Invention

This invention relates to an improved process for obtaining durable press fabrics which exhibit no discoloration and which have higher strength than normally encountered in fabrics treated for durable press properties with a crosslinking agent and an aluminum salt catalyst. Specifically, this invention relates to use of the aluminum acetate salt-sodium chloride mixture produced from reaction of aluminum chloride and sodium acetate as catalyst in formulations containing formaldehyde or a formaldehyde-amide adduct crosslinking agent. Fabrics treated with said formulations have durable press properties and benefit by having no discoloration but higher strength than similarly treated fabrics in the singular presence of either aluminum chloride or sodium acetate as catalyst.

2. The Prior Art

Reeves et al., U.S. Pat. No. 3,526,474, employed metal acetates as polymerization catalysts in a novel finishing treatment for cotton. Although use of aluminum acetate was not demonstrated, Reeves et al., teach that this metal acetate, as well as magnesium acetate and zirconium acetate, is an effective polymerization catalyst. A requirement for polymerization catalysts to be suitable is that they be salts of a weak acid and a weak base. Such catalysts predominantly promote homopolymerization, or copolymerization when a mixture of aminoformaldehyde condensation products are present, to produce insoluble products within a cellulosic fiber rather than promote reaction of the agent with the cellulose. Evidently, the cellulose molecules are not crosslinked appreciably as they do not exhibit significant improvements in conditioned wrinkle recovery angles even though agents which are capable of crosslinking cellulose were cured in the fabrics at elevated temperatures.

Bacon, U.S. Pat. No. 2,992,138, used sodium acetate with zinc nitrate as a catalyst system for treatments with dimethylol ethyleneurea to reduce fabric yellowing, reduce strength loss, and reduce adverse effect on the shade of dyes as caused by zinc nitrate when it alone was used as catalyst.

Irvine and coworkers, American Dyestuff Reporter 48 (12), 37–42, 50 (1959), used modifying salts such as aluminum formate or magnesium chloride with aluminum chloride to avoid two serious disadvantages of aluminum chloride by itself. These disadvantages are: its permanent and high acidity results in excessive tendering of cellulosic fabrics; and its high acidity catalyzes resin condensation in treatment baths causing precipitation.

Hood and Ihde, Journal American Chemical Society, 72, 2094 (1950), by double decomposition of sodium acetate and aluminum chloride prepared basic aluminum acetate which was insoluble in water. These same workers, supra, also produced aluminum triacetate in the absence of water to prevent hydrolysis to Bohmite, AlO(OH).

The aluminum salts, $Al(NO_3)_3$, $Al_2(SO_4)_3$, and $AlCl_3$ are very strong catalysts but each has inherent disadvantages which seriously limit their utility in textile finishing. In addition to those disadvantages cited above for $AlCl_3$, $Al(NO_3)_3$ tenders fabric very badly and causes yellowing which is attributable to oxidation, while $Al_2(SO_4)_3$ also causes tendering and yellowing at curing temperatures of 140° C. and higher.

In the prior art, no suitable means is disclosed for employing an aluminum acetate salt as catalyst in treatments with a cellulose crosslinking agent to produce a satisfactory level of durable press properties in finished fabrics. Homopolymerization or copolymerization of crosslinking agents result on use of aluminum acetate or magnesium acetate rather than effective crosslinking of the cellulose that is needed for the improved wrinkle recovery necessary for durable press performance. The aluminum salts, $AlCl_3$, $Al_2(SO_4)_3$, and $Al(NO_3)_3$, although strong catalysts for the crosslinking of cellulose with methylolamide agents, produce undesirable tendering of the fabric and discoloration.

SUMMARY OF THE INVENTION

The improved process of this invention may be described as one in which a new catalyst system is employed with a cross-linking agent to treat a cellulose-containing fabric to produce a durable press material. The catalyst system is prepared from aqueous aluminum chloride and aqueous sodium acetate to produce an aluminum acetate salt solution containing sodium and chloride ions.

It is an object of this invention to provide an improved process for obtaining durable press fabrics with an aluminum acetate salt catalyst system that has no adverse affect on fabric coloration and gives an acceptable level of strength in the finished fabrics. The importance for fabric treatments with no adverse coloration and no excessive strength loss is readily apparent to those skilled in the art of production of durable press materials.

It is a further object to provide a catalyst system that is operative at curing temperatures of about 130° C. to about 170° C. which are conventional in the textile finishing industry as well as at temperatures of about 200° C. wherein very rapid curing can be accomplished.

We have found that a solution resulting from addition of aqueous sodium acetate to aqueous aluminum chloride can provide an effective catalyst system for treatment of cellulose-containing fabrics with crosslinking agents to produce durable press materials. It is particularly surprising to find such a system is compatible and effective for fabric finishing. As taught by Hood and Ihde, one skilled in the art would predict formation of an insoluble aluminum acetate salt of the essential empirical structure: $Al(OH)(CH_3CO_2)_2$ from the mixture. Use of the catalyst system produced by the mixing of solutions of aluminum chloride and sodium acetate is advantageous over the employment of either component by itself. Thus, the catalyst system of the present invention is effective in producing a durable press fabric with no discoloration and which exhibits greater strength than is normally present in fabric treated to the same level of wrinkle resistance with an aluminum salt catalyst.

DESCRIPTION OF THE PREFERRED EMBODIMENT

Material that may be treated for improved durable press incorporating this catalyst system generally consists of woven fabric but also may be in the form of knits, nonwovens, yarns or fibers. Of significant importance to the material to be treated is that a minimum cellulosic composition of 50% is required. The cellulosic component may be selected from natural cellulosic matter such as cotton, linen, ramie, and the like, or from regenerated cellulosics. The remaining portion of material to be treated may consist of one or more man-made fibers blended with the cellulosic component.

Treating agents, more commonly referred to as crosslinking agents, useful in this improved process include N-methylol amides and aldehydes. Dimethylol dihydroxyethyleneurea, hereinafter referred to as DMDHEU, is the agent selected to demonstrate the improved process in most examples. The concentration of crosslinking agent employed may range from about 5% to about 25%, by weight of treatment solution, with the preferred range being about 7% to 15%.

The mixture of aluminum chloride and sodium acetate to produce the catalyst system comprising an aluminum acetate salt solution containing sodium and chloride ions may be varied in a weight ratio of aluminum chloride to sodium acetate from about 1.6:1 to about 0.5:1. The total weight percent concentration of the equivalent active aluminum acetate ingredient in the treatment bath may be varied from about 0.1% to about 3% with a preferred range of 0.15% to 2.5%. The catalyst of the present invention provides a finishing solution with a pH below 6.5, the pH at which aluminum salts are hydrolyzed to an insoluble form, but above the strongly acidic levels, about pH 1, that are produced by aluminum chloride, aluminum nitrate, and aluminum sulfate as catalysts.

Fabric treatment with the solution containing the crosslinking agent and catalyst system may be accomplished by any suitable means. As a matter of common practice, fabric is immersed in the treatment solution, often referred to as pad bath, to thoroughly saturate the fibers, and then passed through squeeze rolls to adjust the amount of treatment solution retained by the fabric. The amount of treatment solution retained is called the wet pickup which may range from about 50% to 120% based on the dry weight of the untreated fabric. For 100% cotton, the preferred range is 70–90%.

Fabric impregnated with the treatment solution is dried under conditions such that substantially no reaction takes place between the crosslinking agent and cellulose. The dried fabric is then heat treated to bring about the reaction whereby the cellulosic component is crosslinked. Conditions for this heat treatment step range from about 140° C. to about 200° C. for from about 15 seconds to about 3 minutes, time and temperature being inversely adjusted. Equipment used and material being treated will dictate the conditions required.

Once cured, the treated fabric is suitable for utilization in end products for which the fabric is designed. However, we have found it good practice to remove residual water soluble products from the cured fabric by washing.

The following examples illustrate but do not limit the scope of this invention.

EXAMPLE 1

A solution was prepared to contain a molar ratio of $AlCl_3$ to $NaOOCCH_3$ of 0.33 by dissolving 24.6 g. (300 millimoles) of $NaOOCCH_3$ in about 70 ml. of water in a 200 ml. volumetric flask, pipeting in 100 ml. (100 millimoles) of 1 M $AlCl_3$ and diluting the mixture to volume. This solution was labelled Solution A.

Another solution was prepared as was Solution A but substituting 100 millimoles of $Al(NO_3)_3$ for $AlCl_3$. This solution was labelled Solution B.

Another solution was prepared as was Solution A but substituting 50 millimoles of $Al_2(SO_4)_3$ for $AlCl_3$. This solution was labelled Solution C.

Reaction of the $AlCl_3$, $Al(NO_3)_3$, or $Al_2(SO_4)_3$ with $NaOOCCH_3$ in aqueous solution produces NaCl, $NaNO_3$, or $Na_2SO_4$ respectively with an aluminum acetate salt. The exact structure of the aluminum acetate salt present is not known but Solutions A, B, and C each contained a 0.2 molar concentration of the salt.

Solutions for the treatment of fabric were prepared such that each 100 g. of solution contained 9 g. of dimethylol dihydroxyethyleneurea and from 1 to 12.5 millimoles of aluminum acetate salt. The aluminum acetate salt was measured into each treatment solution by pipeting from Solutions A, B, or C respectively.

Cotton printcloth samples were passed into and through their respective treatment solutions, squeezed through pad rolls to about 80% wet pickup, by weight of fabric, then mounted at original dimensions on pin frames. Samples were dried for 7 minutes at 60° C. in a mechanical convection oven, cured for 3 minutes at 160° C., washed in an automatic home wash machine, tumble dried, and evaluated. Test results shown in this and following examples were obtained as follows:

Durable press (DP) ratings after tumble drying (TD) were determined by the procedure of AATCC Test Method 124–1969 (AATCC Technical Manual, Volume 46, pages 177–178, 1970);

Wrinkle recovery angles were determined by AATCC Test method 66–1968 (AATCC Technical Manual, Volume 46, pages 256–257, 1970);

Breaking strengths were determined on 1-inch strips by ASTM Method D1682-64; and, Nitrogen contents were determined by the Kjeldahl method.

TABLE 1

| Catalyst preparation method | Millimoles Al acetate salt per 100 g. treatment solution | pH | DP rating (TD) | Coloration |
|---|---|---|---|---|
| Solution A | 1 | — | 2.5 | |
| | 5 | — | 3.7 | |
| | 10 | 4.1 | 3.7 | |
| | 12.5 | — | 4.0 | |
| Solution B | 1 | — | 2.9 | |
| | 5 | — | 3.4 | |
| | 10 | 3.9 | 4.2 | Light yellow |
| | 12.5 | — | 4.4 | Yellow |
| Solution C | 1 | — | 1.9 | |
| | 5 | — | 2.2 | |
| | 10 | 4.3 | 2.5 | |
| | 12.5 | — | 2.9 | |

Treatment solutions containing Solution A, prepared from $AlCl_3$, as catalyst were effective in producing durable press fabric when 5 or more millimoles of the aluminum acetate salt per 100 g. of treatment solution were used. A rating of 3 or higher is considered durable press by those skilled in the art. No fabric discoloration resulted when Solution A was used as catalyst. Solution B, prepared from $Al(NO_3)$, was satisfactory as catalyst only at the 5 millimole level but not at higher concentrations as fabric discoloration occurred. Solution C, prepared from $Al_2(SO_4)_3$, was not satisfactory in development of a minimum acceptable DP rating of 3.

These results demonstrate that the aluminum acetate salt catalyst containing sodium and chloride ions prepared from solutions of $AlCl_3$ and $NaOOCCH_3$ is effective for development of durable press properties in fabric.

EXAMPLE 2

Treatment solutions were prepared such that each 100 g. contained 9 g. of dimethylol dihydroxyethyleneurea and from 1 to 12.5 millimoles of aluminum acetate salt catalyst obtained from Solution A of Example 1.

Cotton printcloth samples were treated with these solutions following the procedure of Example 1 and then evaluated. Results are shown in Table 2.

TABLE 2

| Millimoles Al catalyst salt per 100 g. treatment solution | Wrinkle recovery angles, W + F | | Brk. str., w, lbs. |
|---|---|---|---|
| | Conditioned | Wet | |
| 1 | 217 | 232 | 44.5 |
| 2.5 | 245 | 236 | 38.2 |
| 5 | 284 | 261 | 27.9 |
| 7.5 | 285 | 261 | 26.7 |
| 10 | 287 | 263 | 22.5 |
| 12.5 | 287 | 266 | 22.2 |
| Untreated | — | — | 48.6 |

The high conditioned and wet wrinkle recovery angles indicate the effectiveness of the aluminum acetate salt catalyst in promoting crosslinking of cellulosic material with a finishing agent. Strengths achieved with the 10 and 12.5 millimole concentrations of catalyst are typical of those of cotton printcloth finished for durable press. It was surprising, however, that treatments with 5 and 7.5 millimoles of catalyst yielded fabrics with even greater strength albeit with equally high levels of wrinkle recovery angles.

EXAMPLE 3

Catalyst systems were prepared as in the following theoretical equations by reaction of aqueous solutions to yield an active aluminum acetate ingredient in the presence of NaCl or NaCl plus $NaOOCCH_3$.

| Mixture | | Active catalyst | |
|---|---|---|---|
| (1) $AlCl_3$ + *NaOOCCH3* | → | $Al(OOCCH_3)Cl_2$ | + NaCl |
| (2) $AlCl_3 + 2NaOOCCH_3$ | → | $Al(OOCCH_3)_2Cl$ | + 2NaCl |
| (3) $AlCl_3 + 3NaOOCCH_3$ | → | $Al(OOCCH_3)_3$ | + 3NaCl |
| (4) $AlCl_3 + 4NaOOCCH_3$ | → | $Al(OOCCH_3)_3 + NaOOCCH_3$ | + 3NaCl |

Treatment solutions were prepared such that each 100 g. contained 9 g. dimethylol dihydroxyethyleneurea and 1 to 12.5 millimoles of equivalent yield of active catalyst based on equations (1) to (4) above.

Cotton printcloth samples were treated with solutions following the procedure of Example 1 and then evaluated. Results are shown in Table 3.

TABLE 3

| Catalyst system (equation no.) | Millimoles active catalyst | DP rating (TD) | Coloration |
|---|---|---|---|
| (1) | 1 | 4.0 | |
| | 2 | 4.5 | |
| | 3 | 4.7 | |
| (2) | 1 | 2.7 | |
| | 2.5 | 3.5 | |
| | 5 | 4.0 | |
| | 7.5 | 4.4 | |
| | 10 | 4.3 | Light yellow |
| | 12.5 | 4.3 | Yellow |
| (3) | 1 | 2.5 | |

TABLE 3-continued

| Catalyst system (equation no.) | Millimoles active catalyst | DP rating (TD) | Coloration |
|---|---|---|---|
| | 2.5 | 3.2 | |
| | 5 | 3.7 | |
| | 7.5 | 4.0 | |
| | 10 | 4.3 | |
| | 12.5 | 4.0 | |
| (4) | 1 | 1.5 | |
| | 2.5 | 2.0 | |
| | 5 | 2.4 | |
| | 7.5 | 2.2 | |
| | 10 | 2.3 | |
| | 12.5 | 2.4 | |

These results demonstrate that aluminum acetate salt solutions prepared by reaction of $AlCl_3$ and $NaOOCCH_3$ at molar ratios of from 1:1 to 3:1 ($NaOOCCH_3$:$AlCl_3$) are effective catalysts for obtaining durable press properties in fabric finished with an N-methylol crosslinking agent. It further demonstrates that concentrations of the active catalyst ingredient formed by the reaction of $AlCl_3$ and $NaOOCCH_3$ may range from 1 to 12.5 millimoles per 100 g. of treatment solution.

EXAMPLE 4

Catalyst systems were prepared following the procedures of Example 1, by mixing 3, 3.1, 3.25, 3.5, 3.75, and 4 moles of $NaOOCCH_3$ per mole of $AlCl_3$ to yield the equivalent active aluminum acetate salt with NaCl or with NaCl plus $NaOOCCH_3$.

Treatment solutions were prepared such that each 100 g. contained 9 g. of dimethylol dihydroxyethyleneurea and 10 millimoles of the equivalent of the active catalyst as in equations (3) and (4) of Example 3.

Cotton printcloth samples were treated with the solutions following the procedure of Example 1 and then evaluated. Results are shown in Table 4.

TABLE 4

| Molar ratio $NaOOCCH_3/AlCl_3$ | DP rating (TD) |
|---|---|
| 3 | 3.7 |
| 3.1 | 3.4 |
| 3.25 | 3.5 |
| 3.5 | 3.3 |
| 3.75 | 2.6 |
| 4 | 2.4 |

Satisfactory DP(TD) ratings of 3 or higher can be achieved by treatments with aluminum acetate catalyst solutions prepared from aqueous sodium acetate and aqueous aluminum chloride in molar ratios of $NaOOCCH_3$:$AlCl_3$ up to 3.5:1. This example demonstrates the upper limit of utility of the aluminum acetate salt catalyst solutions produced by reaction of $AlCl_3$ and $NaOOCCH_3$ in treatment of fabric to obtain acceptable durable press performance.

EXAMPLE 5

Samples of cotton printcloth were impregnated following the procedure of Example 1 with aqueous solutions, 100 g. of which contained 9 g. of dimethylol dihydroxyethyleneurea and as catalyst:

Sample 1—2.5 millimoles $AlCl_3$
Sample 2—5 millimoles $AlCl_3$
Sample 3—10 millimoles $AlCl_3$
Sample 4—2.5 millimoles $Al(NO_3)_3$ Sample 5—5 millimoles $Al(NO_3)_3$
Sample 6—10 millimoles $Al(NO_3)_3$
Sample 7—2.5 millimoles $Al_2(SO_4)_3$
Sample 8—5 millimoles $Al_2(SO_4)_3$
Sample 9—10 millimoles $Al_2(SO_4)_3$; and
Sample 10—12.5 millimoles $NaOOCCH_3$.

The wet, impregnated samples were dried, cured, washed and tumble dried following the procedure of Example 1 and then evaluated. Results are shown in Table 5.

TABLE 5

| Sample | DP rating (TD) | Brk. str., w., lbs. | Coloration |
|---|---|---|---|
| 1 | 4.5 | 16.6 | Light tan |
| 2 | 4.2 | 10.6 | Tan |
| 3 | 4.6 | 10.3 | Brown |
| 4 | 4.2 | 20.2 | Very light yellow |
| 5 | 4.3 | 18.5 | Yellow |
| 6 | 4.3 | 15.7 | Yellow |
| 7 | 4.6 | 21.4 | — |
| 8 | 4.5 | 13.0 | — |
| 9 | 4.5 | 11.1 | Light yellow |
| 10 | 1.5 | — | — |
| Blank | 1.0 | 48.6 | — |

These aluminum salts function very effectively as catalysts in promoting reaction between the finishing agent and cellulose to obtain high levels of durable press smoothness. Strength loss and discoloration, however, are serious disadvantages limiting their utility in practical finishing applications. Sodium acetate, on the other hand, is not an effective catalyst in this process.

EXAMPLE 6

An aqueous solution of catalyst was prepared, as was Solution A in Ex. 1, by adding aqueous $AlCl_3$ to aqueous $NaOOCCH_3$.

Treatment solutions were prepared such that each 100 g. contained:

Sample 11—10 g. of dimethylol ethyleneurea (DMEU) and 7.5 millimoles of the aluminum acetate salt catalyst;

Sample 12—10 g. dimethylol methyl carbamate (DMMC) and 7.5 millimoles of the aluminum acetate salt catalyst;

Sample 13—9 g. of dimethylol dihydroxyethyleneurea (DMDHEU) and 7.5 millimoles of the aluminum acetate salt catalyst;

Sample 14—12.5 g. of trimethylol melamine (TMM) and 10 millimoles of the aluminum acetate salt catalyst;

Sample 15—15 g. of methylated urea-formaldehyde (MeUF) and 10 millimoles of the aluminum acetate salt catalyst;

Sample 16—9 g. of methylated methylol urea (MeUn) and 7.5 millimoles of the aluminum acetate salt catalyst; and, Sample 17—7.5 g. of formaldehyde and 7.5 millimoles of the aluminum acetate salt catalyst.

Samples of cotton printcloth (2 each) were passed into and through the respective treatment solutions, squeezed through pad rolls to about 80% wet pickup by weight of fabric, then mounted on pin frames, and dried for 7 minutes at 60° C. One sample from each treatment was cured for 3 minutes at 160° C. and a second sample from each treatment was cured for 15 seconds at 200° C. (This latter cure is frequently referred to as a flash cure process.) After curing, samples were washed and tumble dried as in Example 1. Results of the above treatments are shown in Table 6.

TABLE 6

| Fabric treatment | DP rating (TD) when cured at: 160° C. | 200° C. | % N when cured at: 160° C. | 200° C. |
|---|---|---|---|---|
| Sample 11 | 4.0 | 3.5 | 1.26 | 1.26 |
| Sample 12 | 3.3 | 3.0 | 0.59 | 0.70 |
| Sample 13 | 3.6 | 3.4 | 0.85 | 0.83 |
| Sample 14 | 3.5 | 3.3 | 4.43 | 4.38 |
| Sample 15 | 3.7 | 3.3 | 2.06 | 1.99 |
| Sample 16 | 3.2 | 3.0 | 0.94 | 0.86 |
| Sample 17 | 3.3 | 3.3 | — | — |

The broad utility of the catalyst is demonstrated by its effectiveness with a wide range of crosslinking agents (including formaldehyde and various types of formaldehyde-amide adducts) to produce fabrics with improved durable press properties. It is further demonstrated that the catalyst is not only effective at the conventional curing temperature of 160° C., but is also effective when a flash cure process is employed.

EXAMPLE 7

13.2 g. (75 millimoles) of $Ca(OOCCH_3)_2.H_2O$ were dissolved in 65 ml. of water. Fifty ml. of 0.5 M (25 millimoles) $Al_2(SO_4)_3$ were pipeted into the solution which resulted in formation of a precipitate. The mixture was filtered and washings of the precipitate were quantitatively collected with the filtrate in a 200 ml. volumetric flask. The solution was made to volume. Although the exact structure of the aluminum acetate salt formed in the reaction between $Ca(OOCCH_3)_2$ and $Al_2(SO_4)_3$ is not known, the reaction is believed to have been according to the following equation:

$$3Ca(OOCCH_3)_2 + Al_2(SO_4)_3 \rightarrow 3CaSO_4(ppt) + 2Al(OOCCH_3)_3$$

The $CaSO_4$ precipitate (ppt) was removed by filtration and the resultant solution, when made to final volume, contained a 0.5 molar concentration of aluminum acetate salt.

Treatment solutions were prepared such that each 100 g. contained 9 g. of dimethylol dihydroxyethyleneurea and:

Sample 18—20 millimoles of this aluminum acetate salt (the pH of this solution was 4.4);

Sample 19—25 millimoles of this aluminum acetate salt, and;

Sample 20—12.5 millimoles of $Ca(OOCCH_3)_2$. (The pH of this solution was 7.0.)

Cotton printcloth samples were treated with these treatment solutions following the procedure of Example 1. Durable press ratings for Samples 18, 19, and 20 were 2.4, 2.3, and 1.4 respectively. These poor ratings demonstrate that the aluminum acetate salt solution prepared from $Ca(OOCCH_3)_2$ is an unsatisfactory catalyst. This catalyst represents essentially an aluminum acetate solution free of other metal salts in that the calcium sulfate produced in the reaction was removed through precipitation and filtration. The poor rating with $Ca(OOCCH_3)_2$ in the treatment solution also demonstrates its ineffectiveness as a catalyst.

EXAMPLE 8

Commercial, reagent grade basic aluminum acetate $[Al(OH)(OOCCH_3)_2]$, was weighed into a beaker, and water was added such that the resultant slurry contained 20 millimoles of the salt. To this slurry was added 40 millimoles of glacial acetic acid. The slurry did not become clear nor did heating affect dissolution indicating the conversion of the $Al(OH)(OOCCH_3)_2$ did not occur as would be expected according to the following equation:

$$Al(OH)(OOCCH_3)_2+CH_3COOH \rightarrow Al(OOCCH_3)_3+H_2O$$

This example demonstrates that basic aluminum acetate, $Al(OH)(OOCCH_3)_2$, is not suitable for catalysis in durable press finishing as the salt is not readily soluble in water nor is it readily converted to the more soluble aluminum acetate having the structure $Al(OOCCH_3)_3$.

EXAMPLE 9

Treatment solutions were prepared such that each 100 g. contained 9 g. of dimethylol dihydroxyethyleneurea and:

Sample 21—7.5 millimoles of aluminum acetate [an aqueous commercial product supplied by American Cyanamid Company with 20±0.8% aluminum as $Al(CH_3COO)_3$];

Sample 22—7.5 millimoles of aluminum acetate [the aqueous commercial product] and 22.5 millimoles of sodium chloride.

Cotton printcloth samples were treated as in Example 6, with the curing steps carried out at 200° C. for 15 seconds. Results of the above treatments are shown in Table 7.

TABLE 7

| Fabric Treatment | DP rating (TD) | %N |
|---|---|---|
| Sample 21 | 2.9 | 0.92 |
| Sample 22 | 3.9 | 1.05 |

The results demonstrate the significance of the presence of sodium and chloride ions in the aluminum acetate solution. The improved DP ratings and the higher level of nitrogen in Sample 22 demonstrate a greater reaction efficiency of the crosslinking agent with cotton when the aluminum acetate is agumented by the presence of sodium and chloride ions.

EXAMPLE 10

A treatment solution was prepared such that each 100 g. contained 9 g. of dimethylol dihydroxyethyleneurea and 10 millimoles of $Mg(OOCCH_3)_2$ (a commercial, reagent grade product).

A cotton printcloth was treated following the procedure of Example 1. The durable press rating of the finished sample was only 1.3, which is an unsatisfactory level of smooth-drying performance.

This demonstrates that $Mg(OOCCH_3)_2$ is unsuitable as a catalyst in the process of finishing cellulosic materials to produce durable press properties.

EXAMPLE 11

Treatment solutions were prepared such that each 100 g. contained 9 g. of dimethylol dihydroxyethyleneurea and 10 millimoles of the aluminum acetate salt from Solution A of Example 1 or 10 millimoles of $AlCl_3$.

Samples from 50/50 cotton/polyester percale sheeting were treated with the above solutions following the procedure of Example 1 and evaluated. Results are given in Table 8.

Table 8

| Catalyst system | Millimoles active catalyst | DP rating (TD) | Coloration |
|---|---|---|---|
| Solution A | 10 | 4.5 | — |
| $AlCl_3$ | 10 | 4.3 | Light brown |
| Untreated | — | 2.5 | — |

This example demonstrates that the aluminum acetate solution prepared by reation of aqueous $AlCl_3$ and aqueous $NaOOCCH_3$ is an effective catalyst in the finishing of textile fabric comprising at least 50% of a cellulosic component to produce acceptable durable press performance. Furthermore, it demonstrates that $AlCl_3$ as catalyst in similar treatment produces discoloration in the finished fabric.

EXAMPLE 12

Catalyst systems were prepared to yield the equivalent active aluminum acetate salt by reaction of aqueous ingredients as in the following equations:

$$AlCl_3+3CH_3COOH \rightarrow Al(OOCCH_3)_3+3HCl \quad (5)$$

$$AlCl_3+3NH_4OOCCH_3 \rightarrow Al(OOCCH_3)_3+3NH_4Cl \quad (6)$$

$$2AlCl_3+3Mg(OOCCH_3)_2 \rightarrow 2Al(OOCCH_3)_3+3MgCl_2 \quad (7)$$

Treatment solutions were prepared such that each 100 g. contained 9 g. of dimethylol dihydroxyethyleneurea and 10 millimoles of the equivalent yield of aluminum acetate based on equations (5) to (7) above.

Cotton printcloth samples were treated with solutions following the procedure of Example 1.

Although each treated sample had an acceptable DP rating of 3.5, discoloration was observed as follows: brown when $CH_3COOH$ was used to prepare the aluminum acetate salt; light yellow when $NH_4OOCCH_3$ was used; and very light yellow when $Mg(OOCCH_3)_2$ was used. These results show that to achieve a satisfactory DP rating with no discoloration only specific combinations of $AlCl_3$ and metal acetates are satisfactory for catalysis in the finishing process.

We claim:

1. In a process for producing durable press properties in cellulose-containing textiles by applying an aqueous solution of crosslinking agent and catalyst, drying, and curing, wherein the improvement comprises: the use as catalyst of an aluminum acetate salt solution containing sodium and chloride ions, prepared by reaction of aqueous aluminum chloride and aqueous sodium acetate.

2. The process for producing durable press textiles without discoloration, said process comprising impregnating a fabric of at least 50% cellulose with an aqueous solution containing a crosslinking agent selected from the group consisting of formaldehyde, dimethylol ethyleneurea, dimethylol methyl carbamate, dimethylol dihydroxyethyleneurea, trimethylol melamine, methylated urea formaldehyde, and methylated methylol uron, and as catalyst an aluminum acetate salt solution containing sodium and chloride ions, prepared by reaction of aqueous aluminum chloride and aqueous sodium acetate wherein the ratio, by weight, of aluminum chloride to sodium acetate is from about 1.6:1 to about 0.5:1, drying the impregnated fabric, and curing the dried fabric at from about 140° C. to about 200° C. for from about 15 seconds to about 3 minutes, time and temperature being adjusted inversely.

* * * * *